US007201104B2

(12) United States Patent
McMurray et al.

(10) Patent No.: US 7,201,104 B2
(45) Date of Patent: Apr. 10, 2007

(54) LEAD ATTACHED SABOT SLUG

(75) Inventors: Christopher R. McMurray, Rineyville, KY (US); Jeffrey W. Stone, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 65 days.

(21) Appl. No.: 10/643,831

(22) Filed: Aug. 19, 2003

(65) Prior Publication Data

US 2004/0079256 A1 Apr. 29, 2004

Related U.S. Application Data

(60) Provisional application No. 60/404,979, filed on Aug. 21, 2002.

(51) Int. Cl.
*F42B 14/06* (2006.01)

(52) U.S. Cl. ..... 102/520

(58) Field of Classification Search ..... 102/520, 102/521, 522, 450, 461, 439
See application file for complete search history.

(56) References Cited

U.S. PATENT DOCUMENTS

| | | | | |
|---|---|---|---|---|
| 2,978,742 | A | 4/1961 | Bliemeister | |
| 3,062,145 | A | 11/1962 | Morgan et al. | |
| 3,444,777 | A | 5/1969 | Lage | |
| 3,623,431 | A | 11/1971 | Hendricks | |
| 3,677,669 | A | 7/1972 | Bliemeister | |
| 3,724,378 | A | 4/1973 | Knight et al. | |
| 3,820,463 | A | 6/1974 | Leonard et al. | |
| 3,961,580 | A | 6/1976 | Burnett et al. | |
| 4,043,267 | A | 8/1977 | Hayashi | |
| 4,471,699 | A | 9/1984 | Turco et al. | |
| 4,587,905 | A | 5/1986 | Maki | |
| 4,718,348 | A | 1/1988 | Ferringo | |
| 4,829,904 | A | 5/1989 | Sullivan | |
| 4,864,934 | A | 9/1989 | Theising | |
| 4,892,861 | A | 1/1990 | Ray | |
| 4,895,076 | A | 1/1990 | Looger et al. | |
| 4,920,888 | A | 5/1990 | Luther et al. | |
| 4,939,997 | A * | 7/1990 | Hoffman | 102/503 |
| 5,086,703 | A | 2/1992 | Klein | |
| 5,127,332 | A | 7/1992 | Corzine et al. | |
| 5,150,909 | A | 9/1992 | Fitzwater | |
| 5,167,697 | A | 12/1992 | Koumura et al. | |
| 5,187,325 | A | 2/1993 | Garvison | |
| 5,263,418 | A * | 11/1993 | Dippold et al. | 102/509 |
| 5,361,701 | A * | 11/1994 | Stevens | 102/450 |
| 5,415,102 | A | 5/1995 | White et al. | |
| 5,479,861 | A | 1/1996 | Kinchin | |
| 5,515,787 | A | 5/1996 | Middleton | |
| 6,067,909 | A | 5/2000 | Knoster, Jr. | |
| 6,073,560 | A * | 6/2000 | Stone | 102/522 |
| 6,481,356 | B2 * | 11/2002 | Gualandi | 102/439 |

FOREIGN PATENT DOCUMENTS

| | | |
|---|---|---|
| CH | 662878 A5 | 12/1978 |
| DE | 2444181 | 1/1976 |

* cited by examiner

*Primary Examiner*—T. Nguyen
(74) *Attorney, Agent, or Firm*—Womble Carlyle Sandridge & Rice PLLC

(57) ABSTRACT

A sabot and a firearm round for a firearm. The sabot includes a compression section defining a payload receiving chamber. The payload chamber receives a slug to form the firearm round. Additionally, the sabot includes a solid section connected to the compression section. The solid section can include a powder cup section for sealing ignition gasses. Typically, the sabot is formed from a high density polyethylene.

51 Claims, 2 Drawing Sheets

LEAD ATTACHED SABOT SLUG

RELATED APPLICATION

This application is a non-provisional application claiming the benefit of Provisional Application Ser. No. 60/404,979, filed Aug. 21, 2002, the content of which is hereby incorporated in its entirety.

TECHNICAL FIELD

The present invention generally relates to ammunition and in particular to a sabot and slug forming a firearm round wherein a compression section forms a payload receiving area.

BACKGROUND

A sabot is a commonly used ordnance term to define a sleeve or carrier to center a sub-caliber projectile in a gun bore. Upon firing, the sabot generally separates from the projectile after the assembly leaves the gun muzzle. Sabots may be used with both conical-shaped bullets as well as traditional lead ball bullets. When used with a firearm with a rifled barrel, the sabot may be used to impart rotation to the projectile as it travels down the gun barrel after firing. In particular, the sabot is typically formed to have a diameter the same as the grooved diameter of the rifled barrel so that the sabot is pressed into the rifling after firing.

Some of the problems encountered in providing a sabot bullet for shotguns include the fact that there exist large variations in shotgun bore diameters, configurations and interior taper or choke. The shellcase diameter will normally exceed the bore diameter or the choke, and therefore any load component, e.g., projectile, wadding, sabot, etc., must either be of a lesser diameter than the minimum choke diameter, or be formed of a material which may compress or otherwise be capable of deformable flow to pass through the choke.

What is needed is a sabot capable of providing safe firearm operation with a low dispersion in an efficient energy transfer manner without damaging the gun barrel.

SUMMARY

Briefly described, the present invention is generally directed to a sabot for a firearm. The sabot includes a compression section defining a payload receiving chamber. The compression section typically includes a plurality of interconnected collapsible fins that can partially collapse when the firearm round is fired. The payload receiving chamber may include a post and a locking ring fitted within the chamber. Additionally, the sabot includes a solid section connected to the compression section. The solid section can include a powder cup section for trapping ignition gasses. Typically, the sabot is formed from a high density polyethylene or similar high strength synthetic material.

Additionally, included in the invention is a firearm round including a sabot and a slug. The sabot includes a compression section defining a payload receiving chamber and a solid section connected to the compression section. The slug is fitted within the payload receiving chamber of the sabot. The slug generally comprises three sections including a stem connected to a driving band and a nose connected to the driving band. The nose section of the slug may include a nose cavity, while the post section includes a post cavity for engaging the post of the payload receiving chamber. The slug commonly comprises at least about 95% by weight lead, though other types of slug material also can be used as known in the art.

In an alternative embodiment, the firearm round includes a sabot having a compression section defining a payload receiving chamber therein and a post integrally formed within the payload receiving chamber. A solid section is connected to the compression section and a slug is fitted to the post of the sabot and rests on the compression section of the sabot.

Various objects, features and advantages of the present invention will become apparent to those skilled in the art upon reading the following specification when taken in conjunction with the accompanying drawings.

DETAILED DESCRIPTION

Figure 1:
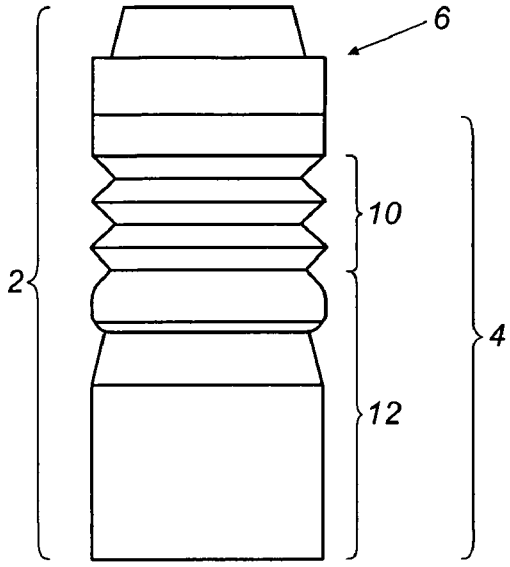
FIG. 1 depicts a firearm round comprising the slug and sabot according to one embodiment of the present invention.
Figure 2:
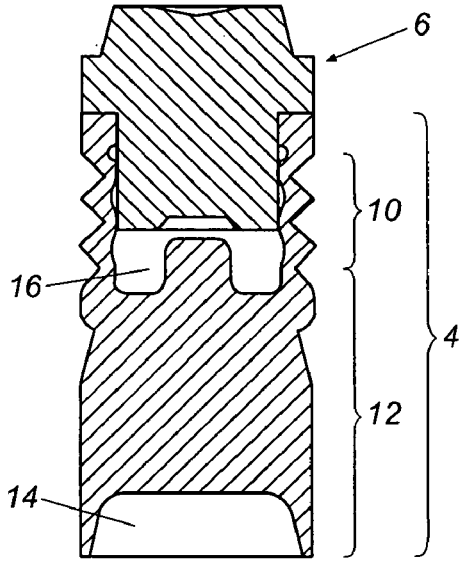
FIG. 2 is a cross-sectional view of the firearm round of FIG. 1.

Referring now in greater detail to the drawings, in which like numeral indicate like parts throughout the views and drawings. FIGS. 1 and 2 illustrate one example embodiment of a firearm round 2 comprising a sabot 4 and a slug 6. The slug 6 is mounted in the payload receiving chamber 8 of the sabot 4. Typically, the slug 6 has an interference fit with the sabot 4; however, the sabot also can, initially, be a loose fit with the slug. Additionally, after the round is fired, the slug typically is further engaged with the sabot 4 by the forces resulting from the sudden acceleration of the firearm round 2.

Figure 7:
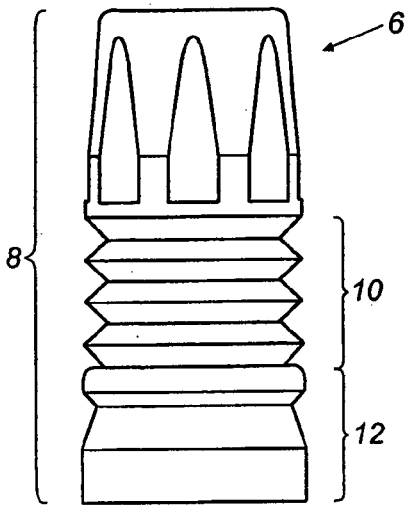
FIG. 7 is an alternative embodiment of the firearm round wherein the slug rests on the compression section of the sabot.
Figure 8:
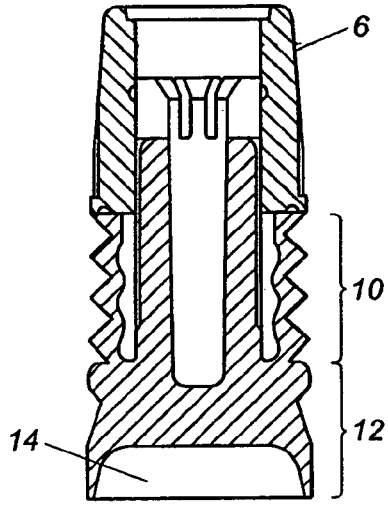
FIG. 8 is a cross-sectional view of the alternative embodiment illustrating the post and hollow slug.

FIGS. 7 and 8 illustrate an alternative embodiment where the slug is substantially hollow and projects forwardly from the compression section 10 of the sabot 4. Additionally, a post 16 substantially fills the payload receiving chamber 8.

Sabot

Figure 3:
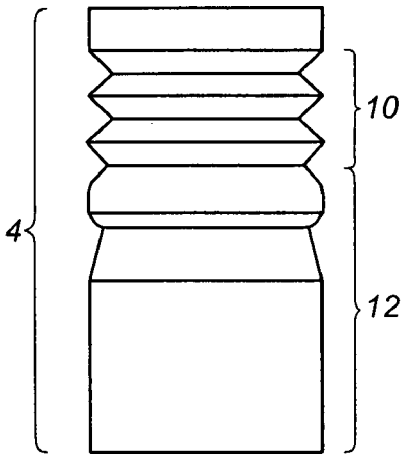
FIG. 3 illustrates the sabot including the compression section and the solid portion of the sabot.
Figure 4:
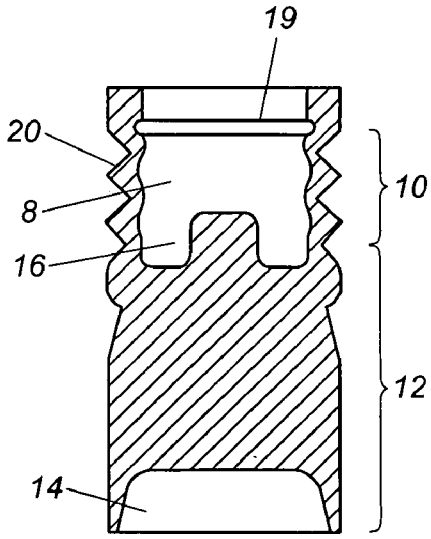
FIG. 4 is a cross-sectional view of the sabot illustrating both the locking ring and the sabot post.
Figure 9:
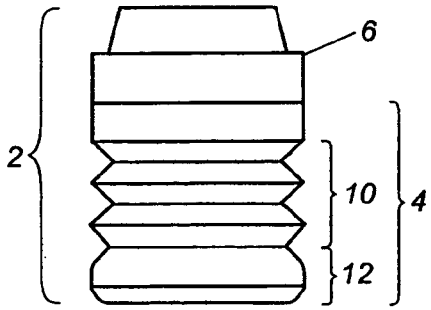
FIG. 9 depicts a firearm round comprising the slug and sabot according to one embodiment of the present invention, wherein the solid section of the sabot is shortened.

FIGS. 3 and 4 illustrate the sabot 4 portion of the firearm round 2. The sabot 4 may be made from linear, high-density polyethylene (HDPE). However, a wide variety of polymers could serve as a suitable material. The sabot generally comprises two sections that can be integrally formed or can be attached as stages or sections. The forward portion or that portion of the firearm round that is the greatest distance from the charge comprises the compression section 10. The rearward section comprises the solid section 12. The compression section 10 generally includes a plurality of interconnected fins 20 that define or form the accordion shaped compression section 10. The fins 20 are further collapsible so as to, partially, compact as the round 2 is discharged from the firearm. Additional embodiments are also contemplated for the compression section 10 other than the fins 20 such as, but not limited to, overlapping segmented rims and collapsible wall segments. The solid section 12 may have varying lengths depending upon the embodiment of the sabot 4. As illustrated in FIG. 9, the solid section 12 may be shorter in length than that illustrated in FIGS. 3 and 4.

The collapse of the compression section 10 produces a volume change to the substantially solid plastic column at the sabot, which allows the internal ballistic characteristics to be modified for optimum performance. The radially symmetric collapse of the compression section 10 walls optimizes the internal ballistics of the loaded round by allowing the forming propellant gases to expand into an increasing volume. For a short duration, this volume expansion allows propellant gases to be expanded while limiting the rise in chamber pressure. The net effect is to allow the projectile to be ejected from the gun at a higher velocity when operating at a maximum peak pressure limit. The area under the pressure-time curve is effectively increased with the peak pressure potentially being held below industry standards for maximum pressure. The compression section 10 is an axisymmetric body of rotation. This allows for substantially uniform, annular compression of the plastic material forming the compression section during the inertial setback of the slug round during firing, which allows the natural centering of the slug post with the sabot and consequently with the bore. Therefore, less projectile deformation is experienced and on-target dispersion is significantly reduced.

As shown in FIG. 4, a combination of internal and external ridges forms the plurality of interconnected fins 20 which allows the compression section 10 to collapse and, upon firing, the base of the stem 22 of the slug 6 and the bottom of the cavity in the compression section 10 are driven together with sufficient force to reform the slug 6. The metal of the slug 6 is swaged into the spaces between the ridges inside the sabot 4. This forms a positive lock between the slug 6 and sabot 4 and ensures consistent longitudinal placement of both the center of gravity and the center of pressure, and to further minimize dispersion of the round. The bottom of the payload receiving chamber 8 also has a post 16, as shown in FIG. 4, which facilitates the expansion of the slug stem 22. The post 16 is not a requirement, as the stem of the slug will "nail-head" significantly without it.

Additionally, a locking ring 19 generally is mounted in the payload receiving chamber 8 and engages the slug 6 received therein. The ring 19 serves to support the slug 6, and minimize slug distortion. The ring 19 can be made of plastic and minimizes the contact of the metal portion of the projectile with the rifling, thus reducing lead deformation. The ring 19 can also include an undercut to serve as an additional locking feature, although such an additional feature is not required. The inner diameter of ring 19 can have a chamfer or radius to facilitate the insertion of the slug.

Furthermore, the sabot 4 includes a propellant powder cup section 14 formed at the rearward section or end of the solid section 12 of the sabot 4 closest to the propellant charge for the round. The cup-shaped propellant or powder cup section 14 is in direct contact with the propellant and seals against the combustion gases generated upon firing. The powder cup section 14 generally is flexible enough to provide a good seal, while possessing the proper rigidity to prevent excessive deformation, which could affect dispersion.

The solid section 12 of the sabot 4 primarily functions to set the overall length of the sabot 4. The length of the solid section 12 can be varied in order to make the sabot suitable for different shell lengths. Typically, the sabot 4 has a length that allows it to be used in both 2¾" and 3" shells, although it could also be modified for use in larger or smaller shells as desired. Additionally, the solid section 12 may also include holes or cutouts to reduce the mass of the sabot. Such holes or cutouts may be desirable to improve the ease with which the part is molded.

Slug

Figure 5:
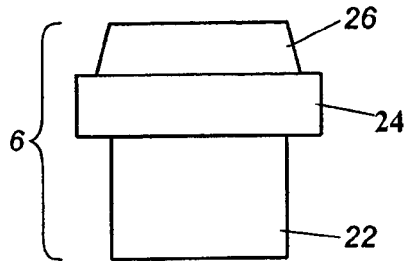
FIG. 5 depicts the slug having a nose, driving band and a stem.
Figure 6:
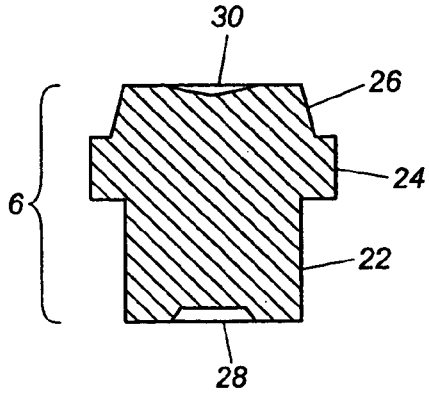
FIG. 6 is a cross-sectional view of the slug incorporating the nose cavity and post cavity.

The slug generally is illustrated in FIGS. 5 and 6. The slug 6 is received and fitted within the payload receiving chamber 8 of the sabot 4. Typically, the slug 6 is formed from lead or a lead alloy, and will include a nose 26, a driving band 24 positioned adjacent the nose 26, and a stem 22 connected to and extending rearwardly from the driving band 24. In greater detail, the slug 6 projectile may be composed of about 95% by weight lead or greater and may include antimony or other materials as known in the art. Additionally, the slug could be coated or plated with a number of materials in order to improve the functional or ballistic characteristics of the system. In one embodiment, the driving band includes a length less than about 25% of the overall diameter of the firearm round.

The stem 22 of the slug is a substantially cylindrically shaped section that generally is small enough in diameter to be easily inserted into the receiving chamber of the sabot 6. The length of the stem 22 may be adjusted such that it projects into the receiving chamber of the compression section sufficiently to ensure that the sabot remains attached. The relationship of the length of the stem 22 and the compression section is such that the compression section is not allowed to compress completely solid and thereby preventing the slug stem from deforming. If the stem is too long, the compression section will not collapse sufficiently, resulting in unfavorable ballistics. If the stem is too short, the compression section will reach a solid, fully compressed state. This condition prevents the slug from being deformed sufficiently to lock the slug and sabot together. The slug and sabot are locked together to avoid separation forces that could cause increased dispersion. The sabot may either be discarded or retained on impact with the target medium. The stem also has a shallow cavity in its base, or a post cavity 28, which engages the post 16 in the payload receiving chamber 8 to aid in centering the slug 6 in the sabot 4 as it is formed. The length of the stem 22 can also be used to fine-tune the location of the center of gravity for the improvement of dynamic and gyroscopic stability.

The driving band 24 is the portion of the slug 6 that can engage the rifling of the barrel of a rifled firearm. The outer diameter of the band 24 typically is at or near the bore or groove diameter of a firearm such as a rifle, shotgun or other type of firearm in which the sabot of the present invention is used. The length of the band is long enough to ensure that the barrel rifling will induce sufficient spin to stabilize the projectile. However, if the band is too long, the depositing of lead in the barrel may adversely affect dispersion of metal from the lead slug 6.

The nose 26 of the slug 6 is designed such that the aerodynamic center of pressure is well forward of the projectile center of gravity to help ensure that the projectile is gyroscopically stable. Furthermore, a nose cavity 30 can be located in the nose 26 of the slug. The nose cavity 30 is a shallow depression in the nose of the slug. The depth of this depression will be optimized to promote expansion without causing the projectile to fragment. This combination can lead to the desirable condition of large expanded diameter (nearly 1") and high retained-weight (approximately 98%).

It will be understood by those skilled in the art that while the present invention has been discussed above with respect to various preferred embodiments and/or features thereof, numerous changes, modification, additions and deletions can be made thereto without departing from the spirit and scope of the invention as set forth in the following claims.

What is claimed is:

1. A sabot having a longitudinal axis, comprising:

a compression section defining a payload receiving chamber at a forward end of the sabot for receiving a slug therein, the compression section including a plurality of fins defined by a combination of alternating ridges on an interior and an exterior surface thereof, wherein the ridges are spaced from one another along the longitudinal axis; and a solid section extending rearwardly from the compression section;

wherein the compression section is adapted to at least partially collapse along a direction of the longitudinal axis upon firing while remaining substantially intact to produce a volume change.

2. The sabot of claim 1, wherein the compression section further includes a locking ring mounted within the payload receiving chamber for engaging the slug.

3. The sabot of claim 2, wherein the locking ring is adjacent to a front edge of the sabot.

4. The sabot of claim 1, wherein the payload receiving chamber further includes a post extending from the solid section toward a forward portion of the sabot.

5. The sabot of claim 1, wherein the solid section includes a powder cup section formed opposite the compression section at a rear portion of the sabot.

6. The sabot of claim 1, wherein the sabot is axisymmetric about the longitudinal axis.

7. The sabot of claim 1, wherein the sabot is polymeric.

8. The sabot of claim 7, wherein the sabot comprises a high density polyethylene.

9. A firearm round having a longitudinal axis comprising:

a sabot including a compression section defining a payload receiving chamber therein and a solid section connected to the compression section, said compression section including a plurality of alternating ridges on an interior and an exterior surface thereof, wherein the ridges are spaced from one another alone the longitudinal axis; and a slug received within the payload receiving chamber of the sabot;

wherein the compression section is adapted to at least partially collapse along a direction of the longitudinal axis upon firing to produce a volume change.

10. The firearm round of claim 9, wherein the slug comprises a nose, a driving band adjacent the nose and a stem connected to the driving band, and wherein the driving band is adapted to engage rifling of a barrel of a rifled firearm.

11. The firearm round of claim 10, wherein the nose of the slug includes a nose cavity.

12. The firearm round of claim 10, wherein the stem of the slug includes a post cavity.

13. The firearm round of claim 12, wherein the payload receiving chamber of the sabot includes a post fitted within the post cavity of the slug.

14. The firearm round of claim 10, wherein the driving band includes a length less than about 25% of an overall diameter of the firearm round.

15. The firearm round of claim 10, wherein the stem has a diameter less than a diameter of the driving band.

16. The firearm round of claim 9, wherein the slug comprises at least about 95% by weight lead.

17. The firearm round of claim 16, wherein the slug further comprises antimony.

18. The firearm round of claim 9, wherein the slug is plated or jacketed.

19. The firearm round of claim 9, wherein the compression section of the sabot further comprises a locking ring mounted within the payload receiving chamber so as to engage the slug.

20. The firearm round of claim 9, wherein the solid section of the sabot includes a powder cup.

21. The firearm round of claim 9, wherein the sabot is axisymmetric about the longitudinal axis.

22. The firearm round of claim 9, wherein the sabot has a front and a rear, the slug abutting a front edge of the front of the sabot.

23. The firearm round of claim 22, wherein the compression section of the sabot further comprises a locking ring adjacent the front edge of the sabot, the locking ring abutting a stem of the slug.

24. The firearm round of claim 23, wherein the slug comprises a driving band abutting the front edge of the front of the sabot, and a nose extending forwardly from the front edge, and wherein the driving band is adapted to engage rifling of a barrel of a rifled firearm.

25. The firearm round of claim 24, wherein the driving band includes a length less than about 25% of an overall diameter of the firearm round.

26. The firearm round of claim 24, wherein the stem has a diameter less than a diameter of the driving band.

27. The firearm round of claim 22, wherein the sabot is polymeric.

28. The firearm round of claim 27, wherein the sabot comprises a high density polyethylene.

29. A sabot having a longitudinal axis, comprising:

a compression section defining a payload receiving chamber therein, said compression section including a plurality of fins defined by a combination of alternating internal and external ridges on an interior surface and exterior surface thereof, wherein the ridges are spaced from one another along the longitudinal axis;

a post integrally formed within the payload receiving chamber;

a locking ring residing within the payload receiving chamber; and a solid section connected to the compression section;

wherein said compression section is adapted to at least partially collapse along a direction of the longitudinal axis upon firing, while remaining substantially intact, to produce a volume change.

30. The sabot of claim 29, wherein the solid section includes a powder cup section.

31. The sabot of claim 29, wherein the sabot comprises a high-density polyethylene, low-density polyethylene, linear, high-density polyethylene, and combinations thereof.

32. The sabot of claim 29, and further comprising a projectile received within the payload receiving chamber and extending forwardly from the compression section.

33. The sabot of claim 32, wherein the sabot is axisymmetric about the longitudinal axis.

34. The sabot of claim 32, wherein the sabot has a front and a rear, the projectile abutting a front edge of the front of the sabot.

35. The sabot of claim 34, wherein the locking ring abuts a stern of the projectile.

36. The sabot of claim 35, wherein the projectile comprises a driving band abutting the front edge of the front of the sabot, and a nose extending forwardly from the front edge, and wherein the driving band is adapted to engage rifling of a barrel of a rifled firearm.

37. The sabot of claim 36, wherein the driving band includes a length less than about 25% of an overall diameter of the firearm round.

38. The sabot of claim 36, wherein the stem has a diameter less than a diameter of the driving band.

39. The sabot of claim 34, wherein the sabot is polymeric.

40. A firearm round having a longitudinal axis, comprising:

a sabot including a compression section defining a payload receiving chamber therein, said compression section including a plurality of fins defined by a combination of alternating internal and external ridges on an interior and exterior surface thereof, a post integrally formed within the payload receiving chamber and a solid section projecting rearwardly from the compression section, wherein the ridges are spaced from one another along the longitudinal axis;

a slug fitted to the post of the sabot;

wherein said compression section is adapted to at least partially annularly collapse along a direction of the longitudinal axis upon firing to produce a volume change.

41. The firearm round of claim 40, wherein the slug comprises a stem defining a chamber adapted to receive the post of the sabot.

42. The firearm round of claim 40, wherein the slug projects forwardly from the compression section of the sabot.

43. The firearm round of claim 40, wherein the post substantially fills the payload receiving chamber.

44. The firearm round of claim 40, wherein the slug comprises at least about 95% by weight lead.

45. The firearm round of claim 40, wherein the sabot is axisymmetric about the longitudinal axis.

46. The firearm round of claim 40, wherein the sabot has a front and a rear, the slug abutting a front edge of the front of the sabot.

47. The firearm round of claim 46, wherein the compression section of the sabot further comprises a locking ring adjacent the front edge of the sabot, the locking ring abutting a stem of the slug.

48. The firearm round of claim 46, wherein the slug comprises a driving band abutting the front edge of the front of the sabot, and a nose extending forwardly from the front edge, and wherein the driving band is adapted to engage rifling of a barrel of a rifled firearm.

49. The firearm round of claim 48, wherein the driving band includes a length less than about 25% of an overall diameter of the firearm round.

50. The firearm round of claim 48, wherein a stem of the slug has a diameter less than a diameter of the driving band.

51. The firearm round of claim 46, wherein the sabot is polymeric and the slug is metallic.

* * * * *